US007055222B2

(12) United States Patent
Bischofberger et al.

(10) Patent No.: US 7,055,222 B2
(45) Date of Patent: Jun. 6, 2006

(54) CLIP FOR CLOTHING STRIPS

(75) Inventors: Jürg Bischofberger, Räterschen (CH); Hans-Rudolf Lörtscher, Winterthur (CH); Peter Gujer, Winterthur (CH); Christian Sauter, Flurlingen (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 10/468,747

(22) PCT Filed: Feb. 22, 2002

(86) PCT No.: PCT/CH02/00105

§ 371 (c)(1),
(2), (4) Date: Mar. 3, 2004

(87) PCT Pub. No.: WO02/068739

PCT Pub. Date: Sep. 6, 2002

(65) Prior Publication Data

US 2004/0154136 A1 Aug. 12, 2004

(30) Foreign Application Priority Data

Feb. 24, 2001 (CH) ..... 326/01

(51) Int. Cl.
*D01G 15/84* (2006.01)

(52) U.S. Cl. ..... 19/114

(58) Field of Classification Search ..... 19/98, 19/102, 104, 105, 110, 111, 113, 114
See application file for complete search history.

(56) References Cited

U.S. PATENT DOCUMENTS

| | | | | |
|---|---|---|---|---|
| 397,265 | A | 2/1889 | Ashworth | |
| 1,709,038 | A | 4/1929 | Platt | |
| 4,513,480 | A | 4/1985 | Bisquolm et al. | |
| 4,528,724 | A | 7/1985 | Bisquolm | |
| 4,827,573 | A | 5/1989 | Kuehl | |
| 5,095,585 | A * | 3/1992 | Grimshaw et al. | 19/113 |
| 5,473,795 | A * | 12/1995 | Spix et al. | 19/113 |
| 5,542,154 | A | 8/1996 | Demuth et al. | |
| 5,755,012 | A | 5/1998 | Hollingsworth | |
| 5,898,978 | A | 5/1999 | Hollingsworth et al. | |
| 6,170,124 | B1 * | 1/2001 | Graf | 19/114 |

FOREIGN PATENT DOCUMENTS

| | | |
|---|---|---|
| AT | 11187 | 3/1902 |
| CH | 654341 A5 | 2/1986 |
| DE | 513728 | 11/1930 |
| EP | 0067600 A1 | 12/1982 |
| EP | 0403111 A1 | 12/1990 |
| EP | 0422838 A2 | 4/1991 |
| EP | 0422838 A3 | 4/1991 |

OTHER PUBLICATIONS

PCT International Search Report, May 8, 2002.

* cited by examiner

*Primary Examiner*—Gary L. Welch
(74) *Attorney, Agent, or Firm*—Dority & Manning

(57) ABSTRACT

The invention relates to fastening means (in particular to so called clothing clips) for the fastening of clothing strips on flat rods, made of light metal or light metal alloys. Thereby the fastening means are laid-out in such a manner that, when the flat rods assume their operating temperature, these are not deformed.

9 Claims, 3 Drawing Sheets

Prior Art

CLIP FOR CLOTHING STRIPS

BACKGROUND OF THE INVENTION

The present invention relates to fastening means, in particular to positive connecting means, as for example clips for fastening of clothing strips to flat rods.

Modern textile processing machines, in particular, cards are furnished with different carding segments, depending on the process stage. Stationary carding segments and/or carding rods to the carding segments of the card belong, in particular, in the pre-carding and re-carding zone and the carding segments. Most cards nowadays are furnished with revolving flat aggregates, i.e., they possess revolving flat rods. Cards with stationary flats and, respective, stationary flat rods are less common. With cards, it is common to furnish the flat or revolving flat rods with so-called clothing strips. The clothing strips are furnished with flexible or semi-rigid clothing, which differ from all steel clothing and/or saw tooth type clothing in such a way, that they are inserted and/or punched individually, or as U-shaped double hooks, into more or less flexible fabric and plastic layers.

The clothing strips are attached with fastening means, so-called clips or clothing strip clips, to the carding rods of the carding segments. Various clips of the state of the art are shown, for example, in the disclosures U.S. Pat. No. 5,755,012, U.S. Pat. No. 5,898,978 and DE 513728. Such an arrangement is, for example, also shown in FIG. 1. The clips 1 are made of sheet metal and/or steel and they advantageously simplify the fastening and replacing of the clothing strips 2 onto the flat rods 3. The clips 1 have the function of fixedly clamping the clothing strips 2 onto the flat rods. They do this by establishing a positive connection between the clothing strip and the flat rod. Normally, the clips are employed in pairs, so that a clip is to ensure for respective clamping on both sides of the flat rod (see FIG. 1). On one side, the clips have teeth 4. These teeth 4 are inserted and/or punched into the clothing strips 2 (illustrated in FIG. 1 with a broken line). Thereby, these teeth 4 are positively connected with the clothing strip. The other side 5 of the clips is pressed around the rib 6 of the flat rod 3 by applying a suitable tool. Thus, the clips 1 firmly clamp the clothing strips 2 to the flat rod 3 over its entire length. This type of fastening has proved successful in the past. The clips can be attached very easily to the flat rods with a suitable tool and can also be easily removed again.

The carding rods, and in particular the flat rods for the card, were formerly manufactured in the form of a—usually T-shaped—cast iron. Recently they have also been manufactured in the form of hollow profiles (extruded profiles) of light metal and/or light metal alloys (e.g., flat rod 3 in FIG. 1). Aluminum is often used as a material for the production. The carding segments co-operate with rotary rollers, as do the flat rods, which co-operate with the cylinder of the card. Thereby, the carding rods or flat rods must be somewhat longer than the working width of the card, so that they can rest on the adjustable flex bends on the left and on the right side of the cylinder and can be transported (or, in the case of stationary flat rods, be fastened thereon). The flat rods are exposed to a relatively high mechanical load (shearing load) applied through their carding work. Therefore, they must have a high stability or rigidity, in order not to deflect or deform during operation.

The carding quality, and thus the quality of the produced card web, depends substantially on the set carding gap (space between the clothing of the flat rods and the clothing of the cylinders). This carding gap is nowadays adjusted within the range of tenth of millimeters. Usually, it measures between 0.2 and 0.3 mm, depending on the processed fibre material and the desired carding quality. It can be observed that the tendency in the spinning mills points in the direction of setting or adjusting the carding gap within ever more narrow ranges. Carding gap settings of 0.15 mm represent at the present the rather extreme case, however, such narrow settings might be wished in the future more frequently by spinning mills. Therefore, the accurate setting of the carding gap is very important. It is, therefore, understood that fluctuations and inaccuracies in the adjusted space have considerable negative effects on the quality of the carding process. For the carding process it is very important that the carding gap over the entire work area within which carding work is done can be adjusted evenly. For example, the carding gap must be accurately adjusted over the total length of the flat rods and over the whole area of the flat (i.e., within the work area of all flat rods being arranged one behind the other). The narrower, however, the carding gap is chosen, the more difficult it is to adjust it and to keep it constant. The narrower the range gets within which the carding gap is to be kept, the more sensitive the flat area reacts, with the set carding gap, to each effect and to each change, like for example temperature fluctuations. The carding gap is adjusted and/or checked during standstill with a feeler gauge. Usually this setting takes place once in each case after each adjustment of the flats of the card, for example, after maintenance (the replacement of the flats) or in the case of a change of the processed material (fiber material to be treated newly often requires another carding gap adjustment). Adjusting of the flats actually always takes place on the "cold machine", i.e. at normal ambient temperature, which can differ, depending on the location of the machine within the spinning mill, between 20 and 30 degrees Celsius. During operation of the card, the operating temperatures at the flat rods, depending on the air conditioning, can amount to between 20 degrees Celsius (during starting period of the machine) and 40 degrees Celsius (with a warm machine and bad air conditioning within the spinning mill). It is understood that the carding gap, even with such temperature fluctuations, is always to be held at the desired value. However, the narrower the carding gap needs to be adjusted, the more sensitive is the reactions of the carding process to changes of the gap.

Recently, the flat rods have been made of light metal, in particular of aluminum, and/or of light metal alloys as extruded hollow profiles, produced by extrusion method (see FIG. 1). Such flat rods are provided with solid headpieces at their two ends. Examples of such flat rods can be seen in the disclosures DE 43 04 148 A1, EP 627,507 B1 or U.S. Pat. No. 4,827,573. The headpieces are usually positively connected with the aluminum profile and have a machined bearing surface, which slides accurately and with low friction on the sliding guides of the card (flex bends). In the case of revolving flat rods, the headpieces are furthermore connected with the drive components of the flat aggregate, e.g., with a driving chain or a driving belt. This design has a number of advantages in comparison to the older type flat rods made as casting. In particular, they can be manufactured more simply and cheaper.

The use of light metal or light metal alloys as material for the flat rods can, however,—under certain operating conditions—also have disadvantages. With such types of flat rods up to now, common type clips made of sheet metal or steel were used. Measurements now revealed that these flat rods can deform when the temperature rises to the operating temperature in the card. The reason for this is that the clips are mounted onto the flat rods at room temperature. In the case of a temperature rise of the card to the operating temperature, the mounted flat rods resume a concave type of shape seen in their longitudinal direction, so that the carding gap is larger in the center of the flat rod than at its end. Thus, the carding process can be impaired. The impairment of the carding process is the more serious the narrower the carding gap is set and the longer the flat rods are. With the carding gap settings applied nowadays, it should therefore be avoided that the flat rods become bent.

OBJECTS AND SUMMARY OF THE INVENTION

Therefore, a principal object of the present invention is thus to avoid the deformation of the flat rods. Additional objects and advantages of the invention will be set forth in part in the following description, or may be obvious from the description, or may be learned through practice of the invention.

The light metal or the light metal alloy of the flat rods has a higher coefficient of elongation and/or coefficient of thermal expansion than the sheet metal and/or the steel from which the clip is made. The commercially available clips thus consist of a material (sheet metal or steel) that has a too high E-modulus for flat rods made of light metal, i.e., they have a low flexibility. They are, in particular, far less flexible than the flat rods. In addition, the clips, apart from the material properties, also have (primarily due to the selected wall thickness) a high rigidity due to the design. In the mounted condition, the clips have a high clamping force and are, practically seen, inelastic. The wall thickness of commercially available clips amounts to at least 0.5 mm. The clothing strips are positively connected ("clipped-on") onto the flat rod at room temperature with the help of the clips and a suitable tool. Afterwards the flat rods are examined for their accuracy with regard to the clothing. If necessary, the clothing points are reground (by a few hundredths of a millimeter), so that the gap between the sliding surfaces of the head pieces of the flat and the area defined by the clothing points resume an accurate predetermined value. This examination is accomplished in the spinning mills at ambient temperature and is made in order to precisely adjust the carding gap. The flat rods with the attached clips and clothing strips are subsequently mounted into the card, at which point they have the ambient temperature. If the card becomes warm through its operation, then also the flat rods warm-up. Consequently, the flat rods expand (or try to expand). The problem, thereby, is that the flat rod has, due to the material type (light metal or a respective alloy), a higher coefficient of thermal expansion than the clip (commercially made of sheet metal or steel). Besides, the clip has, due to the applied material, a high E-modulus (low elasticity), which is additionally reinforced due to its design (wall thickness). The result is a high strength connected with a very low elasticity (at least a lower elasticity than the flat rod). The positive connection of the clips (at least two clips per flat rod are required for the fastening) with the flat rod within the area of the ribs 6 (see FIG. 1) has a high clamping force. It is so high that no relative motion can take place at these points between the flat rod and the strip. In particular, the material with the higher coefficient of elongation cannot expand. Consequently, the lower thermal expansion of the clips prevents the flat rod from expanding within the clamped section 7 in the same way in longitudinal direction as within the upper non-clamped section 8 of the flat rod, where no obstacle prevents the thermal expansion. The arc-shaped bend of the flat rod resulting from this causes an undesired, non-uniform carding gap over the length of the carding flat. Particularly, with narrow settings, where the carding gap is to amount to between 0.2 to 0.15 mm, then this effect is particularly negative.

According to the general idea of the invention, it is to be avoided that the flat rod, due to the fastening device, i.e., the clip, is prevented from expanding evenly. This idea can be realized by different embodiments according to the invention.

According to a first embodiment of the invention, the fastening devices are made of a material that possesses the same coefficient of elongation as the flat rod. In a particularly preferred embodiment, the fastening devices are made of, thereby, also at the same time, of the same material as the flat rod. According to this embodiment of the invention, it is essential that light metal flat rods are being used in combination with the fastening devices (clothing clips), which, according to the invention, comprise the same (or nearly the same) material characteristics.

This first embodiment according to the invention refers to flat rods that are not manufactured of steel or cast iron. It refers, in particular, to flat rods that are manufactured of a light metal or a light metal alloy, in particular, aluminum or an aluminum alloy.

In a second embodiment according to the invention, fastening devices for the fastening of clothing strips on flat rods are used, which are made of aluminum, or aluminum alloy, or another light metal or light metal alloy. This second embodiment according to the invention is concerned with the selection of the material from which the fastening devices are made. In a secondary embodiment the flat rods can be made of a light metal or a light metal alloy, in particular, they can be made of aluminum or an aluminum alloy.

According to a third embodiment of the invention, fastening device for fastening the clothing strips on flat rods are applied that are characterized in that the fastening means are more flexible in their longitudinal direction than in their cross direction.

Such fastening means, or devices, can have such characteristics due to their specific way of design.

These can be realized in particular in that they are designed with predetermined weak points. Such predetermined weak points can be realized in such a manner that the fastening means, with regard to their extension, have different values of elasticity.

In a fourth embodiment according to the invention, fastening devices for fastening the clothing strips on flat rods are applied that have a wall thickness which is smaller than 0.4 preferably smaller than 0.3 mm. By this design measure, it is in particular suitable to apply well known materials for the fastening means, for example, sheet metal or steel. Due to the small cross-section and/or wall thickness, the fastening means, despite an unchanged high E-modulus, is structurally weakened and therefore less rigid. Thereby, the flat rod is given the possibility to expand the fastening means, i.e., the clips, in a longitudinal direction. In fact, the structural weakening reduces the clamping force of the fastening means. The wall thickness however can be selected in such a manner that the weakening does not critically affect the clamping force.

A fifth embodiment according to the invention is characterized in that, between the contact surfaces of the fastening means, or device, and the flat rod, a sliding means is attached.

The sliding means is arranged in such a manner, that it permits the fastening means, as well as the flat rod, to move and/or expand in a longitudinal direction (i.e., along the flat rod) relative to the other element. This relative motion in the longitudinal direction takes place in particular when the temperature of the flat rod rises, so that the component with the higher coefficient of elongation (e.g., the flat rod) can expand in the longitudinal direction unhindered from the other component (e.g., fastening means). This basically means that the fastening means does not have to take part in this movement or expansion of the flat rod: The flat rod can expand unhindered, and, thus, no tensions can develop, which could cause a bending of the components. The clamping effect of the fastening means (transverse to the longitudinal direction of the flat rod) does not become affected.

In a variation of this fifth embodiment, the sliding means between the contact surfaces of fastening means and flat rod is realized as a glide layer with a low coefficient of friction.

With this embodiment of the invention, the flat rod is preferably made of a light metal or a light metal alloy. In particular, it is made of aluminum or an aluminum alloy.

The object of the invention, which in all foregoing embodiments of the invention is called "fastening means, or device" can also be a so-called clip, in particular, for fastening of clothing strips onto flat rods (revolving flat or stationary flat rods) of the card. In addition, the clothing strips can be furnished with an allsteel clothing (saw tooth type clothing). The object of the invention is not limited to the application in flat rods of the card. It can also serve, in particular, as fastening means for other carding segments with other clothing types (carding segments of the card, such as those of other blow room machine, in particular, cleaners). The object of the invention is also preferentially suitable as a fastening means for carding segments with all steel clothing. The fastening means according to the invention can therefore also be applied in other carding segments in the card or in a cleaner of the blow room. Together, with the card go the carding segments in the pre-carding zone or re-carding zone of the cylinder, or the carding segments at the licker-in. With cleaners, the fastening means can be applied with stationary carding segments. If the fastening means is a clip, then it can be made of sheet metal, preferably of steel.

If the sliding means between the contact surfaces of fastening means and flat rod is being realized as a gliding layer with a low coefficient of friction, then the gliding layer can be applied in the form of a coating, in particular, a plastic coating, on the fastening means and/or on the flat rod. The application of the coating can also take place later. In a preferred embodiment, the coating is applied only on the contact surfaces between the fastening means and the flat rod.

In a further preferred embodiment of the invention, the fastening device has teeth, which are stable enough to be entered or punched into the fabric and/or plastic layers of the clothing strips. This feature applies in particular to fastening means which are not made of steel or sheet metal, but, for example, are made of aluminum or some other material. Such fastening means according to the invention are, in particular, suitable for the fastening of clothing strips on machine components of the card.

For the fastening of the clothing strips on the flat ends preferably at least two fastening means are applied according to the invention.

The present invention is further described in the following figures by ways of examples.

DETAILED DESCRIPTION

Reference will now be made in detail to the presently preferred embodiments of the invention, one or more examples of which are shown in the figures. Each example is provided to explain the invention and not as a limitation of the invention. In fact, features illustrated or described as part of one embodiment can be used with another embodiment to yield still a further embodiment. It is intended that the present invention cover such modifications and variations.

Figure 1:
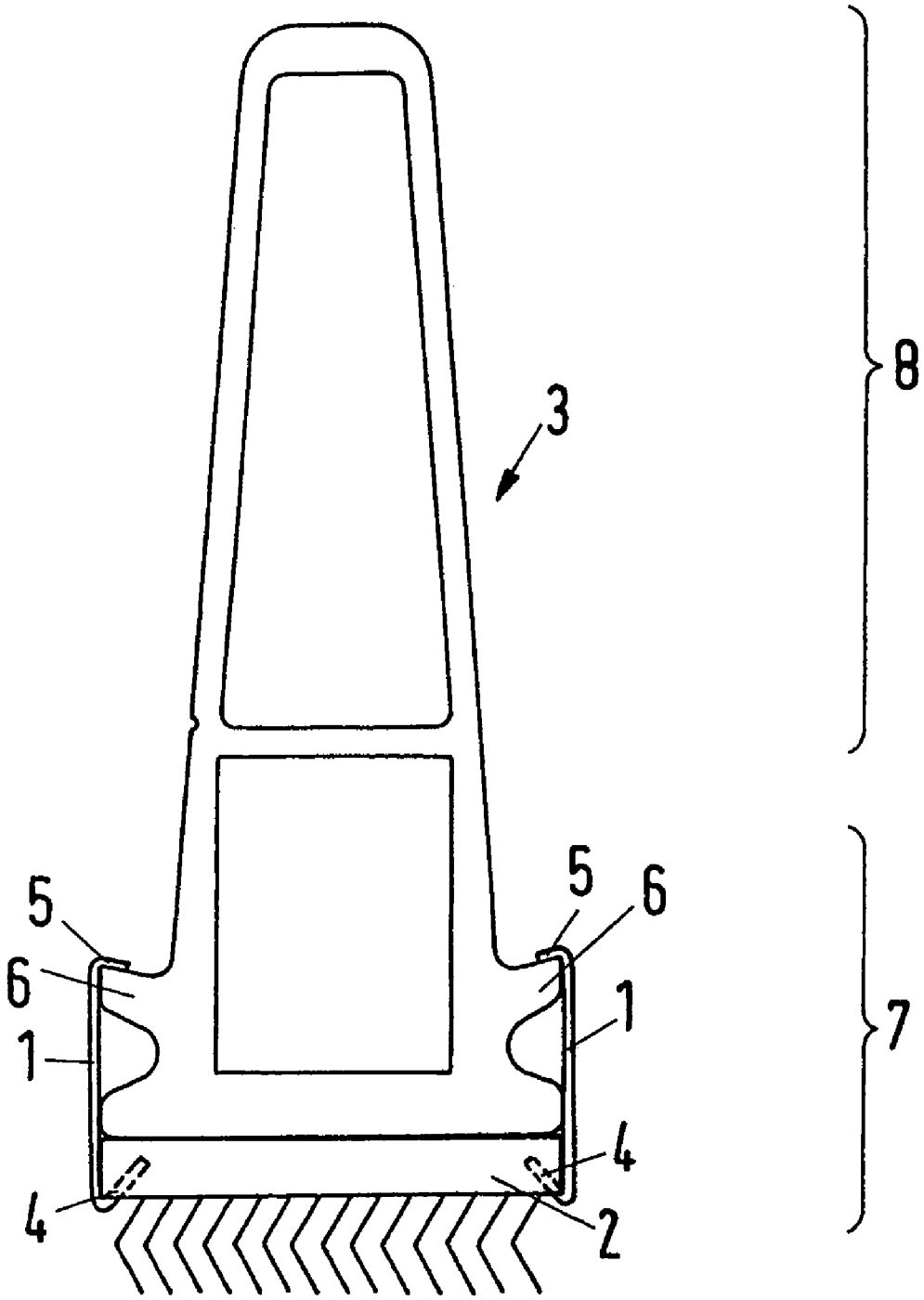
FIG. 1 shows a flat rod with clips according to the state of the known art.

The flat rod in FIG. 1 was already described further above. Therefore, there is no need for further explanation. The clips 1 are manufactured of sheet metal or steel according to the state of the art and have a wall thickness of 0.5 mm. The flat rod 3 is made of a light metal or a light metal alloy. This combination has the above-described disadvantages.

Figure 2:
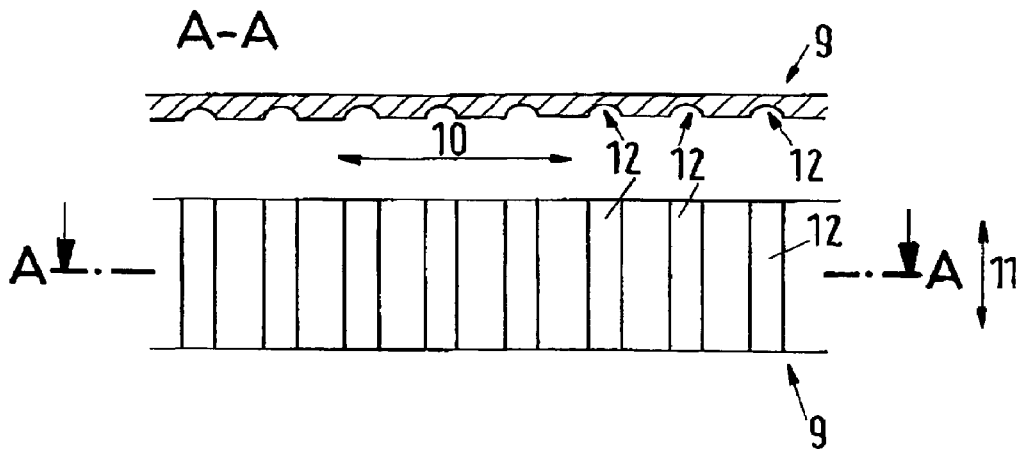
FIG. 2 shows a fastening means according to an embodiment of the invention.

In FIG. 2, a fastening means, or device, according to an embodiment of the invention is shown (in two views). The fastening means 9 according to the invention is more flexible in its longitudinal direction 10 than in its transverse direction 11. This characteristic was achieved at the fastening means 9 by way of its structural design. It has groove shaped predetermined weak points 12 at regular spaces in its longitudinal direction 10. The wall thickness is reduced at these points, so that the fastening means 9 has an overall reduced rigidity in longitudinal direction 10 and thus a higher elasticity. By this structural design, the clamping force in cross direction 11 is hardly reduced and the elasticity of the fastening means 9 is only insignificantly increased.

Figure 3:
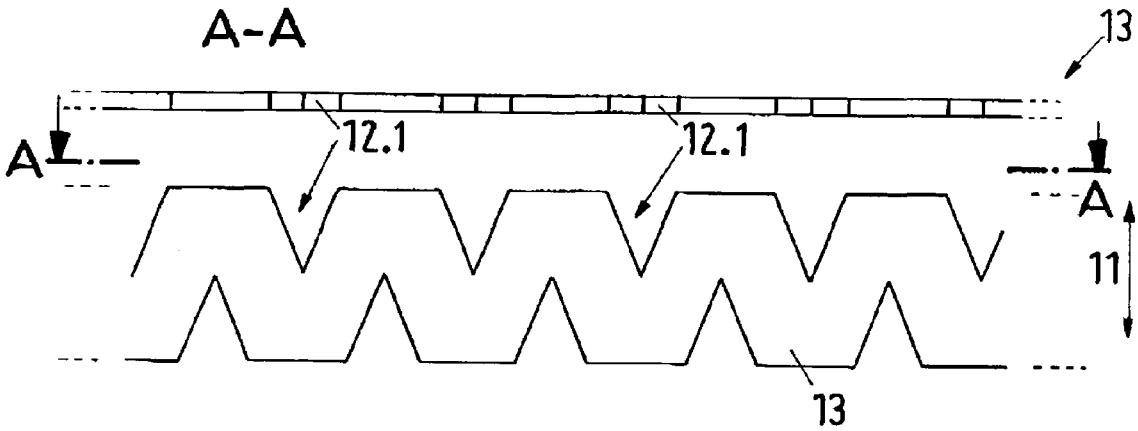
FIG. 3 shows a variation according to another embodiment of the invention.

The FIG. 3 shows a further variation of the embodiment in FIG. 2 according to the invention, likewise in two views. Here also, predetermined weak points 12 in the form of punched material are worked into the fastening means, or device, 13. Thus, the fastening means receive a direction-controlled elasticity and/or rigidity, and thus the fastening means 13 becomes lengthwise flexible. In cross direction 11, however, it keeps the required rigidity.

Figure 4:
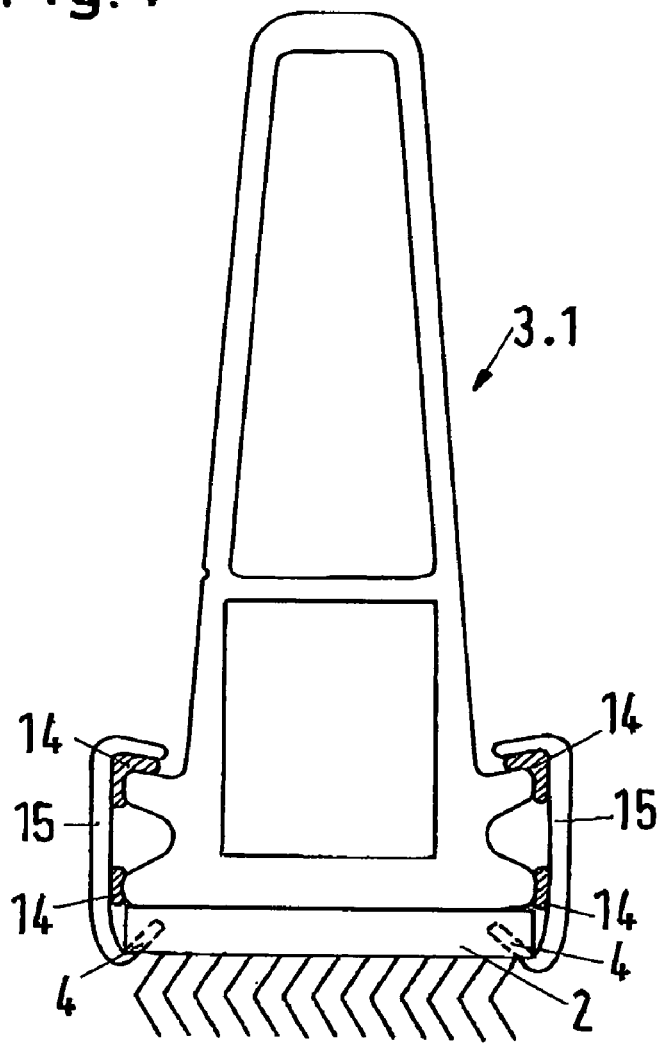
FIG. 4 shows a fastening means according to a further embodiment of the invention with sliding means.

The FIG. 4 shows a flat rod 3.1 with a clothing strip 2, which is attached by two fastening means, or devices, 15 according to the further embodiment of the invention.

Between the contact surfaces of fastening means 15 and the flat rod 3.1 sliding means 14 are attached. In this embodiment, the two fastening means 15 also have teeth 4, which engage in the clothing strip 2 of the fabric layer. The sliding means 14 are here only to be understood as schematic illustrations. They permit the flat rod 3.1 and the fastening means 15 to move relatively to each other (in viewing direction, i.e., in a longitudinal direction of the flat rod 3.1), in particular to expand relatively to each other at a temperature rise. As sliding means 14, gliding layers could, for example, be applied, which have a low coefficient of friction. The sliding means 14 can be applied both on the fastening means 15 and/or on the flat rod 3.1. The sliding means 14 can only be attached on the contact surfaces (as shown), or extend beyond one and/or the other component (fastening means 15 or flat rod 3.1) covering it entirely or partly (not shown). For example, the fastening means 15 could be completely surrounded and/or coated by the sliding means 14. The illustrated sliding means 14 can also be a plastic coating (or a silicone layer).

Figure 5:
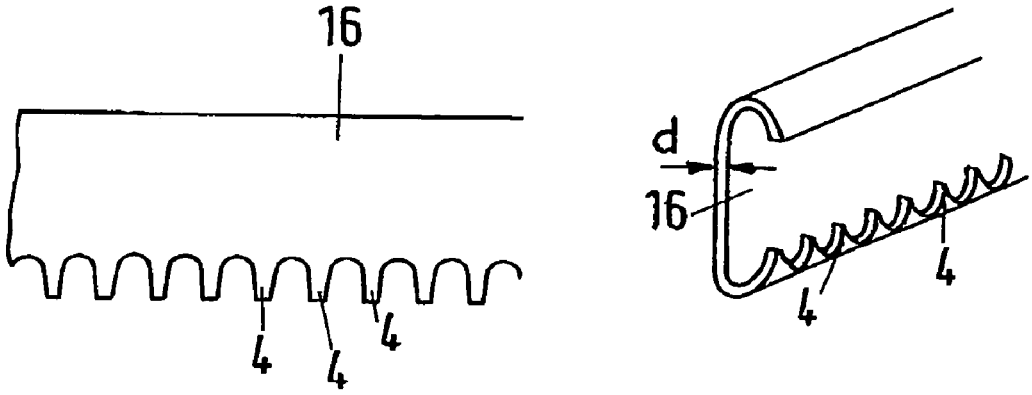
FIG. 5 shows a further fastening means according to the invention.

The FIG. 5 shows a detail of a fastening means, or device, 16 according to the invention. Thereby the fastening means 16 is shown in two conditions. The illustration on the left shows the fastening means 16 in the unbent condition on which one sees in particular the teeth 4.

According to one design of an embodiment of the invention, the fastening means 16 can comprise a wall thickness d, which is thinner than 0.4 mm, preferably thinner than 0.3 mm.

The illustration on the right shows the fastening means 16 in the form as it is applied in mounted condition (without flat rod or clothing strip). One sees the way the teeth 4 are pointing upward. During a normal assembly, these are punched and/or pressed into the fabric layers of the clothing strip (see teeth of FIG. 4). The teeth 4 according to the invention are designed in such a manner (e.g., by their form and dimensions) that they are stable enough in order to be engaged in the fabrics and/or plastic layers of the clothing strips.

The fastening means according to the invention consists preferably of a material which possesses the same coefficient of elongation as light metal or light metal alloys, under which particularly is to be understood aluminium or aluminium alloys. The fastening means consists in particular of a material which possesses the same coefficient of elongation as the material of which the flat rods are manufactured, whereby these are preferably produced of light metal or light metal alloys.

The invention also concerns the use of fastening means on the flat rods, made of light metal, for the fastening of clothing strips.

With the expression "fastening means" clips for the fastening of clothing are to be understood in particular. These clothing could be flexible clothing, in particular so-called clothing strips, but also allsteel clothing, e.g. saw tooth clothing. Preferably the fastening means according to the invention are applied for the flat rods of the card. They are, however, not limited to this application. The fastening means according to the invention can in particular also serve for the fastening of other carding segments, in particular for stationary carding segments in the pre-carding zone and in the re-carding zone of the card, as well as at its licker-in and at cleaners in the blow room. The fastening means according to the invention can be used for example for applications according to the disclosures CH 659,832, CH 654,341, CH 655,521 in place of the conventional clips or clips described there, in particular for holding allsteel clothing and so-called card clothing.

The invention is not limited to the possibilities and embodiments explicitly being specified. These variations are rather meant as suggestions for the specialist for the realisation of the idea of the invention in a most favourable manner. From the described forms of embodiments, therefore, further favorable applications and combinations are easily derivable, which likewise reflect the idea of the invention and which are to be protected by this application. It will be appreciated by those skilled in the art that various modifications and variations can be made in the present invention without departing from the scope of the invention. It is intended that the present invention include such modifications and variations as come within the scope of the appended claims and their equivalents.

The invention claimed is:

1. An apparatus for the fastening of clothing strips on a flat rod made of at least one of a light metal or a light metal alloy, said apparatus comprising a fastening means being constructed of material which possesses the same coefficient of elongation as said at least one of a light metal or a light metal alloy of said flat rod.

2. An apparatus as in claim 1, wherein said fastening means includes the same material as the flat rod.

3. An apparatus as in claim 1, wherein said fastening means is comprised of at least one of a light metal or a light metal alloy.

4. An apparatus as in claim 3, wherein said fastening means is comprised of at least one of aluminum or an aluminum alloy.

5. An apparatus as in claim 4, wherein said flat rod is comprised of at least one of aluminum or an aluminum alloy.

6. An apparatus as in claim 1, wherein said fastening means is a clip.

7. An apparatus as in claim 1, wherein said fastening means comprises teeth for inserting into at least one of fabric or plastic layers of a clothing strip.

8. An apparatus as in claim 1, wherein the fastening means is suitable for fastening of clothing strips onto mechanical components of a card.

9. An apparatus as in claim 1, wherein at least two fastening means are used to fasten said clothing strip onto said flat rod.

* * * * *